United States Patent [19]

Seager

[11] Patent Number: 4,917,273

[45] Date of Patent: Apr. 17, 1990

[54] STRAP DISPENSER

[75] Inventor: Richard H. Seager, Mystic, Conn.

[73] Assignee: Risdon Corporation, Naugatuck, Conn.

[21] Appl. No.: 254,443

[22] Filed: Oct. 6, 1988

[51] Int. Cl.[4] ..... B67D 5/42

[52] U.S. Cl. ..... 222/392; 222/386; 222/145

[58] Field of Search ..... 222/392, 94, 145, 386

[56] References Cited

U.S. PATENT DOCUMENTS

| | | | |
|---|---|---|---|
| 1,025,511 | 5/1912 | Craven . | |
| 1,036,970 | 8/1912 | Craven | 222/392 |
| 1,810,249 | 6/1931 | Koehler . | |
| 2,012,396 | 8/1935 | Luce | 222/392 X |
| 2,402,072 | 6/1946 | Nehrke | 222/392 X |
| 2,789,731 | 4/1957 | Marraffino | 222/94 X |
| 3,201,003 | 8/1965 | Wark et al. | 222/386 X |
| 3,229,865 | 1/1966 | Heisler et al. . | |
| 3,231,139 | 1/1966 | Bouet . | |
| 3,774,809 | 11/1973 | Bratton | 222/392 X |
| 4,437,584 | 3/1984 | Connors et al. . | |
| 4,637,746 | 1/1987 | Vierkotter . | |
| 4,645,098 | 2/1987 | Hoffmann | 222/386 |
| 4,793,526 | 12/1988 | Webb | 222/392 X |

FOREIGN PATENT DOCUMENTS 47393 3/1982 European Pat. Off. .

*Primary Examiner*—Kevin P. Shaver
*Assistant Examiner*—Boris Milef
*Attorney, Agent, or Firm*—St.Onge Steward Johnston & Reens

[57] ABSTRACT

The present invention relates to a strap dispenser formed from a tubular container with a product outlet. Within a chamber defined by the container is a piston intregally formed with a strap which advances the piston toward the outlet to dispense material in the chamber. The strap extends toward the outlet within the chamber but passes through an opening outside of the chamber and into a slot formed in the container's periphery. It is the portion of the strap extending outside the chamber that enables actuation of the piston. The opening is defined by a guide around which the strap bends as it moves toward the opening and a wiper which with the guide removes material from the strap. The piston may be formed from a plurality of ribs each having a cutout to pass around the container surface which defines the slot. The smooth surface of the slot and the strap enables the entire contents of the chamber to be quickly dispensed at one time. In addition, the outlet can be provided with a tube to permit dispensing of a striped product formed from two separate materials within the chamber.

14 Claims, 2 Drawing Sheets

STRAP DISPENSER

BACKGROUND OF THE INVENTION

It has been known for some time to dispense materials stored in a container by moving a piston longitudinally through the container toward a product outlet. Movement of the piston is effected by a longitudinal strap (i.e., either a strand bendable in three dimensions or a ribbon bendable in two dimensions) having one end connected to the piston and the other end attached to an actuating lever externally accessible with respect to the container. However, prior art strap dispensers have had a significant problem with leakage of flowable materials proximate to where the strap passes from within the container to its exterior. As a result, it has been necessary to withdraw the strap from within the container at a location behind the piston where no material to be dispensed is present, as shown in U.S. Pat. No. 3,229,865 to Heisler et al. ("Heisler"), U.S. Pat. No. 1,025,511 to Craven ("Craven"), and U.S. Pat. No. 1,810,249 to Koehler ("Koehler"). In Heisler and Koehler, the piston or product conveying element is pushed toward the dispenser outlet using a rigid strap. This type of strap, as opposed to one which pulls the piston, adds significantly to the weight of the dispense. When, however, the strap pulls the piston, it is necessary to prevent leakage by providing a hole in the piston through which the strap exits, as shown by Craven. At this location distal from the product outlet, leakage is unlikely, but a more complicated structural arrangement is required. Only when a non-flowable material is dispensed has it been possible to withdraw the strap from the container interior above the piston, as taught by U.S. Pat. No. 3,231,139 to Bouet.

SUMMARY OF THE INVENTION

The present invention relates to a strap dispenser for flowable material (e.g., toothpaste) comprising a container with a chamber in which this material is held, a product outlet through which the material is dispenser, and a piston to advance material within the chamber toward the product outlet. The dispenser also includes a strap with one end attached to the piston and the other end attached to an actuating lever. The strap extends, within the chamber, in a first direction from the piston toward the product outlet, passes to the exterior of the chamber through an opening at a location intermediate the piston and the outlet, and extends toward the lever in a second direction generally opposite the first outside the chamber. Within the chamber, there is a guide around which the strap bends as it passes to the exterior and a wiper which with the guide removes material from the strap as it moves out of the chamber. Together, the guide and wiper define the opening through which the strap passes out of the chamber.

Once it leaves the chamber, the strap moves within a slot in the container but outside the chamber. Preferably, the container has a circular or other symmetrically-shaped cross-section with the slot being within the container's periphery. Since the slot extends into the container's interior, a portion of the piston is cut out to accommodate the slot. The actuating lever, attached to the end of the strap distal from the piston, extends outside the slot to enable movement of the piston within the chamber to expel the contents thereof. Due to the smooth surfaces of the strap and slot, all the material in the chamber can be quickly and easily discharged at one time.

Another aspect of the present invention relates to the integrally-formed connection of the strap to the piston. Preferably, the piston comprises a plurality of ribs (e.g., 2–5 ribs) which extend radially outwardly from the strap.

The strap dispenser of the present invention can be used to dispense two materials in a striped pattern. This result is achieved by filling one end of the chamber with one material and the other end of the chamber with another. A tube within the chamber is connected to the product outlet and extends to the interface of the two materials. The tube has a plurality of axially-extending grooves through which one material enters the tube, while the other material enters the tube through an opening in its end distal from the product outlet. The passage of both these materials into the tube is effected by movement of the piston toward the product outlet, resulting in a striped, dispensed product.

DETAILED DESCRIPTION OF THE DRAWINGS

Figure 1:
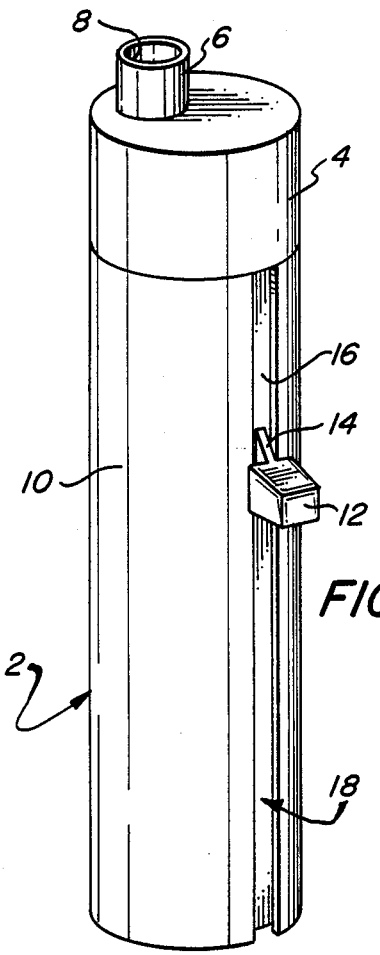
FIG. 1 is a perspective view of a strap dispenser according to the present invention.

FIG. 1 is a perspective view of a strap dispenser, according to the present invention, provided with a cap 4 mounted on body 10. Cap 4 is provided with a discharge tube 6 having outlet 8 for dispensing material T, which is preferably toothpaste, from within chamber 19 of body 10. Body 10 is provided with a slot 18 to receive strap 16. At one end of strap 16, there is an actuating lever 12 connected to strap 16 by lever connector 14.

Figure 2:
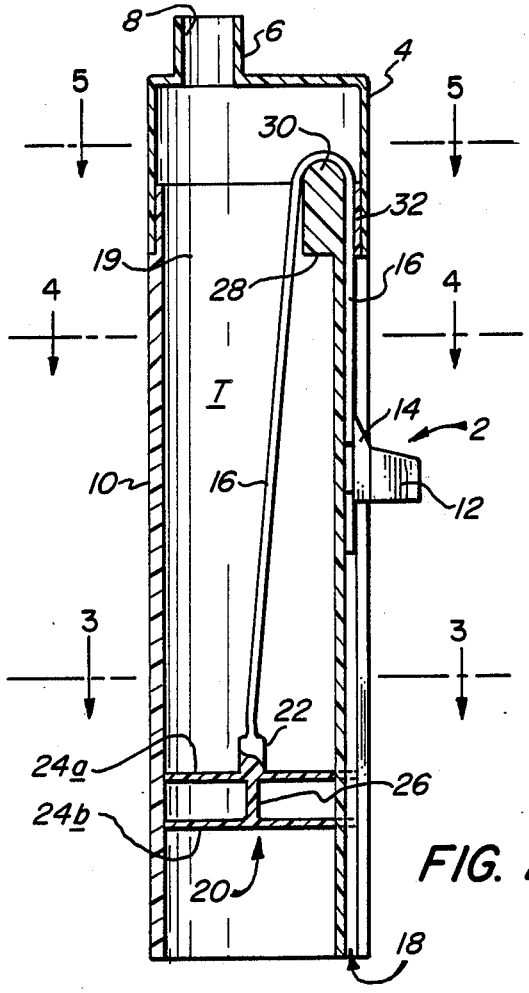
FIG. 2 is a side cross-sectional view of a strap dispenser according to the present invention.

As shown in more detail in FIG. 2, which is a side cross-sectional view of a strap dispenser according to the present invention, strap 16 is connected to displacement piston 20 within chamber 19 at piston connector 22. Extending radially outwardly from piston connector 22 is upper rib **24*a* which is connected by rib connector 26 to lower rib 24*b*. Although FIG. 2 shows only two ribs, 24*a* and 24b, piston 20** can be constructed from more than two ribs (e.b., 3–5 ribs).

Figure 5:
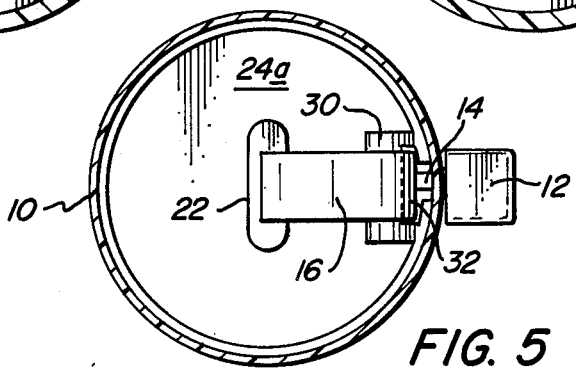
FIG. 5 is a cross-sectional view of a strap dispenser according to FIG. 2 taken along line 5—5.

As also shown in FIGS. 2 and 5, strap 16 extends from piston 20 toward outlet 8 within chamber 19. Near the upper end of chamber 19, strap 16 bends around guide 30 and passes outside dispenser 2 into slot 16. As strap 16 passes outside chamber 19, it is wiped free of material T by guide 30 and wiper 32. Together, guide 30 and wiper 32 from an opening through which strap 16 passes out of dispenser 2 into slot 16. Guide 30 is also provided with a stop surface 28 within chamber 19 to prevent piston 20 from passing above that point.

Figure 3:
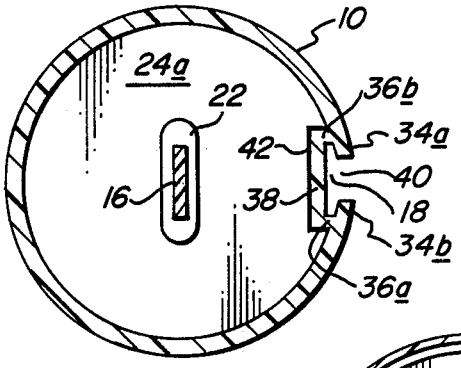
FIG. 3 is a cross-sectional view of the strap dispenser of FIG. 2 taken along line 3—3.

FIG. 3 is a cross-sectional view of the strap dispenser of FIG. 2 taken along line 3—3 which shows that body 10 has a circular periphery within which slot 18 is formed. Slot 18 is separated from chamber 19 by back wall 38, front walls 34*a* and 34b, and side walls 36*a* and 36*b*. There is an opening 40 within the circular periphery of body 10. To accommodate slot 18, rib 24*a* is provided with upper rib cutout 42.

Figure 4:
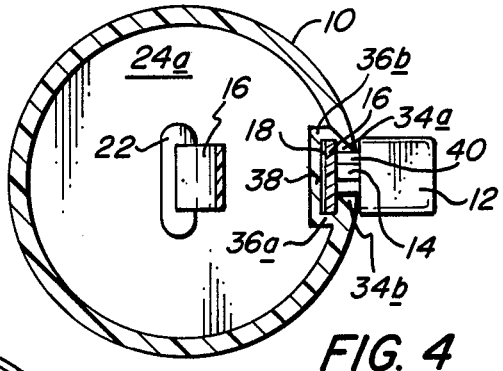
FIG. 4 is a cross-sectional view of the strap dispenser of FIG. 2 taken along line 4—4.

FIG. 4 is a cross-sectional view of the strap dispenser according to FIG. 2 taken along line 4—4 which shows that strap 16 is fitted within slot 18 and is closely surrounded by front walls 34*a* and 34*b*, side walls 36*a* and 36*b*, and back wall 38. Actuating lever 12 is connected to strap 16 by lever connector 14 which extends through opening 40. By virtue of the smooth contacting surfaces of strap 16, front walls 34*a* and 34*b*, side walls 36*a* and 36*b*, and back wall 38, strap 16 slides easily within slot 18 to enable the entire contents of dispenser 2 to be discharged quickly and easily.

Figure 6:
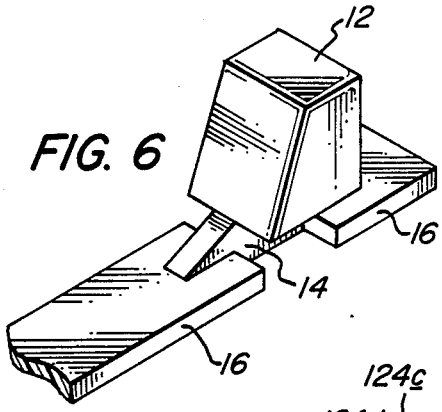
FIG. 6 is a perspective view of an actuating lever for the strap dispenser according to the present invention.
Figure 7:
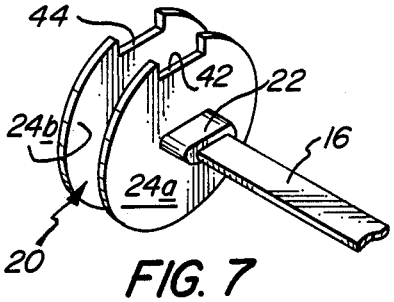
FIG. 7 is a perspective view of a displacement piston for the strap dispenser according to the present invention.

As illustrated in FIG. 2, strap 16 is connected to both actuating lever 12 and piston 20. The connection of lever 12 to strap 16 by lever connector 14 is illustrated in FIG. 6. In FIG. 7, the connection of strap 16 to rib 24*a* of piston 20 by piston connector 22 is depicted. Not only does upper rib 24*a* have an upper rib cutout 42 for slot 18, but lower rib 24*b* is also provided with a lower rib cutout 44 for the same purpose.

In operation, the embodiment of FIGS. 1–7 can be used to discharge material T by pulling actuating lever 12 which moves strap 16 within slot 18 toward the bottom of body 10. As strap 16 is pulled downwardly through slot 18, around guide 30, and upwardly within chamber 19, material T on strap 16 is removed by guide 30 and wiper 32. As a result, little, if any, material T passes outside chamber 19 and into slot 18. The movement of strap 16 within slot 18 toward the bottom of body 10 causes piston 20 to move upwardly within chamber 19, resulting in the discharge of material T through discharge tube 6 and outlet 8 of cap 4. Such upward movement of piston 20 continues until upper rib 24*a* abuts stop surface 28 of guide 30. Due to the close clearance of ribs 24*a* and 24*b* with respect to the interior surfaces of body 10, front walls 34*a* and 34*b*, side walls 36*a* and 36*b*, and back wall 38, little material T is left on the interior surfaces of body 10, which piston 20 has moved upwardly past. The serial arrangement of ribs 24*a* and 24*b* is especially helpful in this regard, because any material which rib 24*a* leaves beneath it is likely to be removed by rib 24*b*.

Figure 8:
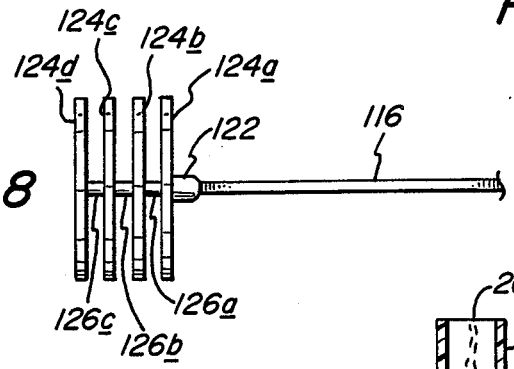
FIG. 8 is a side view of another type of displacement piston for the strap dispenser according to the present invention.

As noted previously, piston 20 can be constructed from more than two ribs. FIG. 8 illustrates a side view of a displacement piston for the strap dispenser of the present invention, having four ribs 124*a–d*. Strap 116 is attached to rib 124*a* by piston connector 122. In turn, rib 124*b* is connected to rib 124*a* by rib connector 126a, while rib 124*c* is connected to rib 124*b* by rib connector 126*b*, while rib 124*d* is connected to rib 124*c* by rib connector 126*c*. The serial arrangement of the four ribs, 124*a–d*, is even more effective in removing virtually all material on the interior surface of the dispenser body than the two-rib embodiment. As in the embodiment of FIG. 7, ribs 124*a–d* would be provided with cutouts if used in conjunction with a body 10 within which are slot-defining surfaces.

Figure 9:
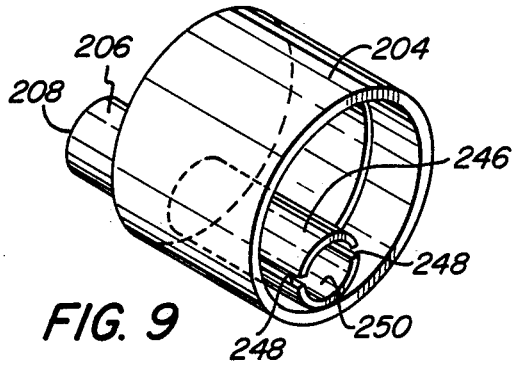
FIG. 9 is a perspective view of a second embodiment of a cap for a strap dispenser according to the present invention which can be used to dispense a striped product.
Figure 10:
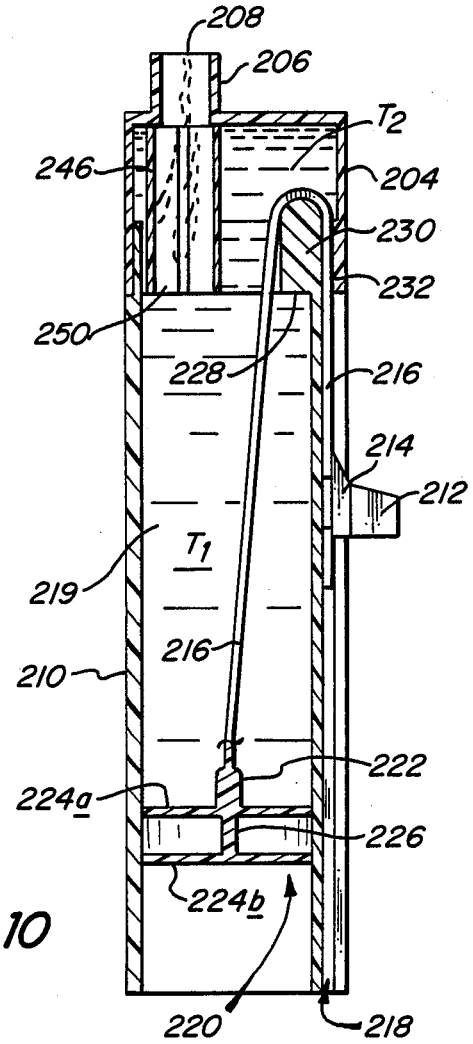
FIG. 10 is a cross-sectional view of the strap dispenser of the present invention equipped with the cap of FIG. 9 to discharge a striped product.

FIGS. 9 and 10 show a second embodiment of the present invention for dispensing two materials in a striped pattern. Like the embodiment of FIGS. 1–7, the embodiment of FIGS. 9–10 has a cap 204 with a discharge tube 206 and an outlet 208. However, extending beneath discharge tube 206 is feed tube 246 having inlet grooves 248 and inlet hole 250, as shown in FIG. 9. In this embodiment, as shown in FIG. 10, chamber 219 within body 210 is filled with a first material $T_1$, while cap 204 is filled with a second material $T_2$. The interface of materials $T_1$ and $T_2$ is located at a level in alignment with inlet hole 250. In all other respects, the embodiment of FIGS. 9–10 is the same as that of FIGS. 1–7. A strap 216 extends between piston 220 and actuating lever 212 (via lever connector 214). Piston 220 is integrally formed with strap 216 by means of piston connector 222 which connects strap 216 to upper rib 224*a*. Rib connector 226, in turn, connects lower rib 224*b* and upper rib 224*a*. The upward travel of piston 220 is limited by guide surface 228 against which upper rib 224*a* will abut. As strap 216 is pulled upwardly by actuating lever 212, it bends around guide 230, passes between guide 230 and wiper 232, and moves outside of dispenser 202 into slot 218. As in the embodiment of FIGS. 1–7, guide 230 and wiper 232 remove material $T_1$ and $T_2$ from strap 216, and slot 218 is configured similarly to slot 18.

In operation, the embodiment of FIGS. 9–10 is very similar to that of FIGS. 1–7. However, as piston 220 is moved upwardly toward outlet 208, material $T_1$ enters feed tube 246 through inlet hole 250. The upward travel of piston 222 also forces material $T_2$ into feed tube 246 through inlet grooves 248 by virtue of pressure exerted on the static column created by materials $T_1$ and $T_2$. These materials contact one another within feed tube 246 and are then pushed upwardly through discharge tube 206 and out of outlet 208 as a product with a striped pattern of materials $T_1$ and $T_2$.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A strap dispenser comprising:

a longitudinal container defining a chamber for storing material to be dispensed;

an outlet to discharge the material from the chamber;

a piston within the chamber and movable in a dispensing direction toward said outlet to discharge the material;

a longitudinal strap connected to said piston and extending within the chamber substantially in the dispensing direction;

an opening in said container between said piston and said outlet through which said longitudinal strap passes from within the chamber to the outside of it, said strap extending outside the chamber in a direction substantially opposite the dispensing direction, wherein movement of the portion of said strap outside the chamber away from said outlet pulls said piston toward said outlet, thereby pushing the material in the chamber toward said outlet; and a guide within the chamber for supporting said strap as it turns within the chamber from the dispensing direction to the opposite direction toward said opening.

2. A strap dispensing according to claim 1 further comprising:

a wiper within the chamber and adjacent said opening at a location where said wiper removes material from said strap as it moves in the direction substantially opposite the dispensing direction to the outside of the chamber.

3. A strap dispenser according to claim 2, wherein said guide is positioned adjacent said wiper to define said opening.

4. A strap dispenser according to claim 3, wherein said guide is positioned to block movement of said piston in the dispensing direction beyond said guide.

5. A strap dispenser according to claim 1 further comprising:

a slot extending longitudinally along said container for slideably receiving said strap after it passes through said opening.

6. A strap dispenser according to claim 5, wherein said slot has a smooth surface to permit said strap to be rapidly pulled through it, whereby said piston is pulled rapidly toward said outlet to dispense substantially all the material.

7. A strap dispenser according to claim 5, wherein said slot is positioned within said container but outside the chamber.

8. A strap dispenser according to claim 7, wherein said piston is provided with a cutout to permit said piston to pass through the chamber and around said slot.

9. A strap dispenser according to claim 5 further comprising:

a lever connected to said strap at an end distal from said piston, whereby movement of said lever along said slot moves said strap within said slot.

10. A strap dispenser according to claim 1 further comprising:

a lever connected to said strap at an end distal from said piston, whereby movement of said lever along said slot moves said strap within said slot.

11. A strap dispenser according to claim 1, wherein said piston comprises a plurality of ribs positioned in series within the chamber.

12. A strap dispenser according to claim 1, wherein said piston is integrally formed with said strap, and the plurality of ribs are longitudinally-spaced along said strap.

13. A strap dispenser according to claim 1, further comprising:

a tube connected to said outlet and terminating at a distal end located in the chamber between said outlet and said piston, said tube having a plurality of open, axially-extending grooves, wherein said tube enables two materials to be stored in the chamber and dispensed in a striped pattern, the first material being positioned in the chamber between said piston and the distal end, the second material being positioned in the chamber between said outlet and the distal end.

14. A strap dispenser comprising:

a longitudinal container defining a chamber for storing material to be dispensed, said container having an outer surface with a symmetric cross-section;

an outlet to discharge the material from the chamber;

a piston within the chamber and movable in a dispensing direction toward said outlet to discharge the material, said piston comprising a plurality of ribs positioned in series within the chamber;

a longitudinally strap connected to said piston, extending substantially in the dispensing direction, and ultimately passing outside the chamber in a direction substantially opposite to the dispensing direction, said piston being integral with said strap such that each rib is longitudinally-spaced along said strap, whereby said strap is positioned to effect movement of said piston within the chamber toward said outlet;

a slot within said container and outside the chamber for slideably receiving said strap;

an opening in said container through which said strap passes from within the chamber to said slot outside the chamber;

a guide within the chamber for supporting said strap as it turns within the chamber from the dispensing direction to a substantially opposite direction toward said opening;

a wiper within the chamber and adjacent said guide at a location where said wiper removes material from said strap as it moves in the direction substantially opposite the dispensing direction to the outside of the chamber, wherein said guide and said wiper define said opening; and a lever attached to said strap at an end distal from said piston, whereby movement of said lever along said slot moves said strap within said slot.

* * * * *